United States Patent [19]

Kershaw

[11] Patent Number: 5,016,022

[45] Date of Patent: May 14, 1991

[54] MONOPOLE INDUCTIVELY LOADED ANTENNA TUNING SYSTEM

[75] Inventor: Joseph F. Kershaw, La Mesa, Calif.

[73] Assignee: The United States of America as represented by the Secretary of the Navy, Washington, D.C.

[21] Appl. No.: 301,909

[22] Filed: Sep. 14, 1981

[51] Int. Cl.[5] ..... H01Q 9/00

[52] U.S. Cl. ..... 343/750

[58] Field of Search ..... 343/749, 750, 856, 850, 343/860, 861, 864

[56] References Cited

U.S. PATENT DOCUMENTS

| | | | |
|---|---|---|---|
| 3,129,386 | 4/1964 | Daly | 343/749 |
| 3,381,222 | 4/1968 | Gray | 343/750 |
| 3,445,849 | 5/1969 | Sanford | 343/749 |
| 3,689,928 | 9/1972 | Felsenheld | 343/749 |

OTHER PUBLICATIONS

De France; *Communications Electronics Circuits;* Rinehart Press; San Francisco, Calif., pp. 466, 467; 1966.

*Primary Examiner*—William L. Sikes
*Assistant Examiner*—Robert E. Wise
*Attorney, Agent, or Firm*—Harvey Fendelman; Thomas Glenn Keough

[57] ABSTRACT

A monopole inductively loaded antenna system is disclosed in which the antenna system is tuned to resonance and impedance matched without making changes to the loading inductance or other antenna elements. The monopole inductively loaded antenna is supported by a base insulator having an antenna side and ground plane side. A variable capacitor is positioned on the ground plane side of the base feed insulator for tuning the antenna system to resonance. One of a plurality of impedance matching transformers is selectively switched into the antenna system to match the antenna load to the transmitter.

9 Claims, 1 Drawing Sheet

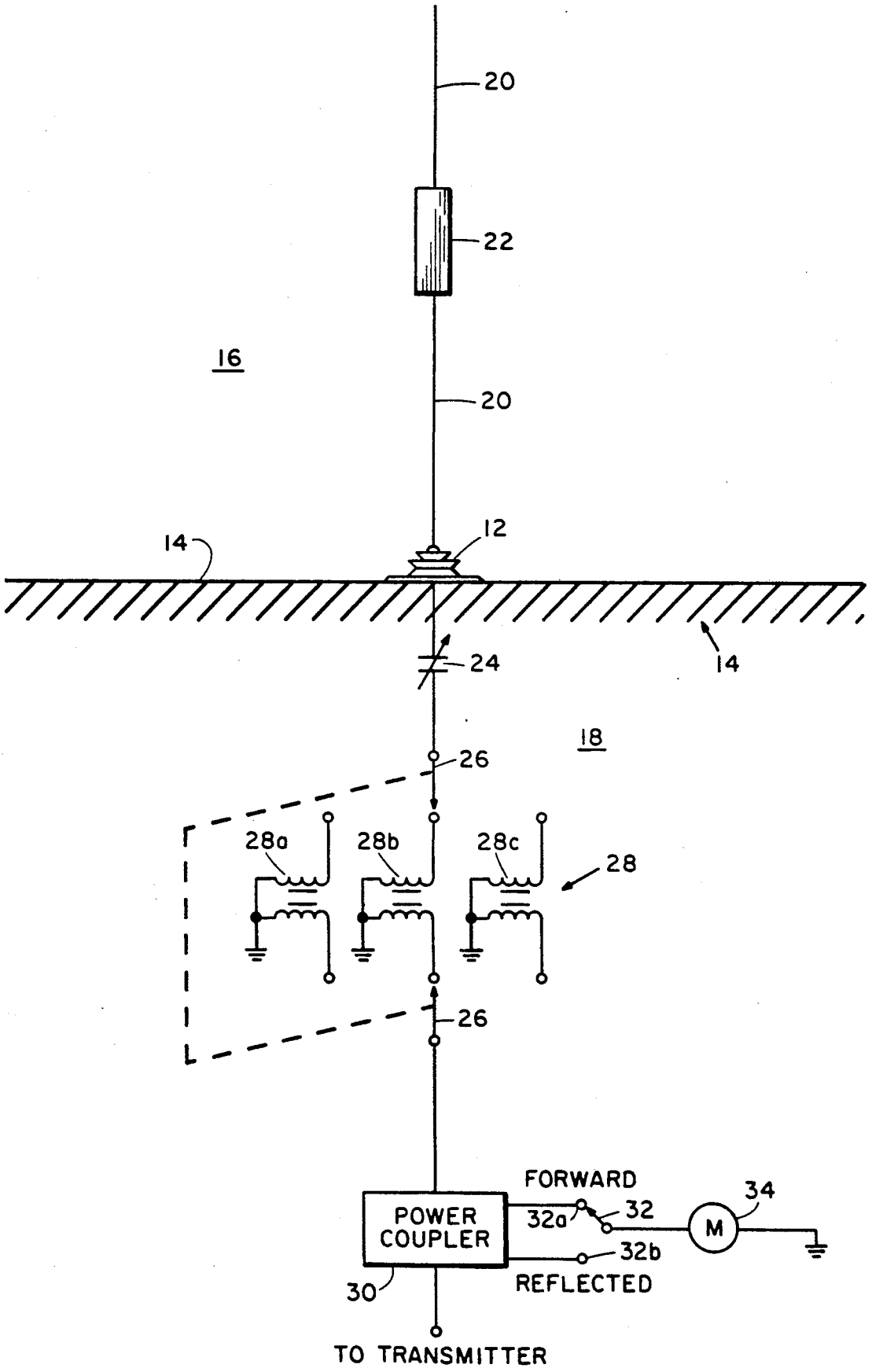
20
22
16
20
12
14
14
24
18
26
28a
28b
28c
28
26
FORWARD
34
POWER COUPLER
32a
32
M
32b
REFLECTED
30
TO TRANSMITTER

MONOPOLE INDUCTIVELY LOADED ANTENNA TUNING SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates generally to monopole inductively loaded antennas and, more particularly, to techniques for tuning such antenna systems when a change in operating frequency is desired. Previous methods for changing the operating frequency of an inductively loaded antenna were accomplished by physical changes to the loading inductance by a series of tapped connections along the inductor or by repositioning a magnetic core or by changing the length or configuration of the antenna elements. There techniques involve the use of inductor taps and contacts or mechanical controls which are troublesome in a normal environment and much more troublesome in a salt water environment. Additionally, inductor taps require an operator to go to the antenna and make tap changes. This, however, is not always an acceptable procedure as in a marine environment during wet deck conditions, at night, or in rough seas. Some methods for changing operating frequency have used remotely controlled motorized tap selection, but these introduce another element of unreliability as well as mechanical complexity. Further, such techniques typically require additional wires in proximity to the antenna element which usually necessitate RF decoupling. To date, there has been disclosed no system for changing the operating frequency of an inductively loaded antenna suitable for use in marine environments or the like where it is impracticable or impossible to make physical changes to antenna element itself or to the antenna loading coil.

SUMMARY OF THE INVENTION

The present invention provides a technique and apparatus for changing the operating frequency of an inductively loaded antenna over a frequency range many times greater than the natural bandwidth of the antenna without making changes to the loading inductance or antenna elements. The present invention further relates to a mechanism for changing the operating frequency of an inductively loaded monopole antenna without mechanical changes to the loading inductance such as a tapped inductance or movable core or by changes to the antenna elements. The present invention is particularly suitable for marine environments or the like where it is desirable to change the operating frequency of the antenna from an area that is isolated from the antenna. For instance, naval submarines utilize inductively loaded monopole antennas mounted on the exterior of the submarine. During inclement weather, high sea states or combat conditions, it often becomes necessary to change the operating frequency of these antennas. Obviously, under these conditions, it would be extremely dangerous or fatal to attempt to change the antennas elements or the inductive load of the antenna from a location on the exterior of the submarine. The present invention obviates the necessity of subjecting operating personnel to the hazardous conditions that may be present in the environment of the antenna. This is accomplished by the use of a variable tuning capacitor in series with the antenna element and positioned on the ground plane side of the base insulator of the antenna element. By this technique, the tuning capacitor may be placed in an interior or otherwise safe location with respect to the antenna element. Impedance matching of the antenna system may also be accomplished in accordance with the present invention by utilization of a plurality of impedance matching transformers selectively connectable by a switch mechanism to the series variable capacitor. Thus, in accordance with the present invention, the operating frequency of the inductively loaded antenna can be changed from a position of relative safety with respect to the antenna elements. Further, no tap conditions on the inductive load of the antenna element are necessary and the use of motors and/or mechanical control shafts in the vicinity of the inductor are not required. Hazards to personnel as the result of wet deck conditions, darkness, rough seas, combat and the like are eliminated when frequency changes are made to the antenna system in accordance with the present invention.

OBJECTS OF THE INVENTION

Accordingly, it is the primary object of the present invention to disclose a novel technique and mechanism for changing the operating frequency of an inductively loaded antenna.

It is a concomitant object of the present invention to disclose a technique for changing the operating frequency of an inductively loaded antenna without making changes to the loading inductance or the antenna elements.

It is a further object of the present invention to provide a technique for changing the operating frequency of an inductively loaded monopole antenna without mechanical changes to the loading inductance or changes to the antenna elements.

Other objects and many of the attendant advantages of this invention will be readily appreciated as the same becomes better understood by reference to the following detailed description when considered in connection with the accompanying drawings.

BRIEF DESCRIPTION OF THE DRAWINGS

The sole FIGURE is a schematic diagram of the inductively loaded antenna system of the present invention.

DESCRIPTION OF THE PREFERRED EMBODIMENT

Referring now to the drawing, the inductively loaded antenna system of the present invention will now be described. The antenna system of the present invention comprises a base insulator 12 which is preferably secured to a ground plane mounting surface 14. The mounting surface may be the exterior shell of a naval vessel such as a submarine or it may be the exterior surface of a tank, or aircraft, or it may be a building or any other structure that separates the area and environment 16 from the area 18. The antenna elements 20 are coupled through the base insulator 12 on the antenna side of the feed point base insulator 12. The antenna elements 20 may be embodied as a fiberglass tube with a copper conductor inside as is well known. Any other monopole antenna elements may be used for the elements 20 depending on the circumstances. A loading inductance 22 is illustrated in the figure in a center loaded position. It is to be understood, however, that the present invention is not limited to a center loaded monopole antenna and that the monopole may be base loaded, top loaded or inductively loaded in any other position depending upon the circumstances and particular requirements. On the ground plane side of the base insulator feed point 12, a series, variable capacitance frequency tuning capacitor 24 is connected to the antenna elements 20. Variable, frequency tuning capacitor 24 is connected via ganged switches 26 to one of the impedance matching transformers 28. It is noted that there are illustrated three impedance matching transformers 28*a*, 28*b* and 28*c*. It is to be understood, however, that the present invention is not limited to the use of three impedance matching transformers and that either fewer or greater number of impedance matching transformers may be utilized depending upon particular system requirements. Each of the RF impedance matching transformers 28 has a different impedance on the antenna side of the transformer and each is designed to match a different impedance load to the transmitter. For instance, in a typical application, the system transmitter would be designed for use with a fifty ohm load. The impedance matching transformers 28 would thus be designed so that regardless of the impedance presented by particular antenna elements 20, inductive load 22 and tuning capacitor 24, one of the impedance matching transformers 28 would be suitable to match that load to the transmitter such that the transmitter would effectively see a 50 ohm load. More than one impedance matching transformer 28 is required because a change in a frequency of operation of the antenna would also change the impedance of that antenna as should be readily understood. A directional power coupler 30 is connected via the ganged selector switches 26 to the impedance matching transformers 28. A meter switch 32 actuable between contact positions 32*a* and 32*b* is connected to the power coupler 30 as illustrated in the figure. Finally, a power meter 34 is connected at one end to the selector switch 32 and is grounded at its other end as illustrated.

The antenna system of the present invention is designed so that the combination of inductive reactance of the antenna system and capacitive reactance of the antenna system resonate at the lowest operating frequency. Changing to a higher operating frequency is accomplished in the present invention by reducing the capacitance of variable capacitor 24. Changes in impedance are compensated for by switching to the appropriate transformer 28 by means of the ganged switch 26. In order to tune the antenna system, the operator would make a fine tuning adjustment by adjusting the variable capacitor 24 for minimum reflected power as would be indicated on power meter 34. Variable capacitor 24 may be set to a preliminary value from predetermined tables or by experimentation.

These and other features, objects, and advantages of the present invention will be better appreciated from an understanding of the operative principles of a preferred embodiment as described hereinafter and as illustrated in accompanying drawings.

What is claimed is:

1. In a monopole, inductively loaded antenna system including a monopole antenna element secured to a base insulator, said base insulator being affixed to a ground plane, there being an area above said ground plane and an area below said ground plane and including a loading inductance connected in series with said antenna element in the area above said ground plane, the improvement comprising:

means for tuning said antenna system to resonance, said tuning means being positioned in the area below said ground plane.

2. The system of claim 1 wherein said tuning means comprises:

a variable capacitor connected in series with said antenna element.

3. A monopole inductively loaded antenna system comprising:

an inductively loaded monopole antenna element;

a ground plane, there being an area above said ground plane and an area below said ground plane;

a base insulator for supporting said monopole antenna element affixed to said ground plane, said antenna element being coupled to said base insulator in said area above said ground plane;

a loading inductance connected in said antenna element; and means connected to said antenna element and positioned in said area below said ground a plane for varying the resonant frequency of said inductively loaded monopole, antenna said varying means comprising a variable tuning capacitor.

4. A monopole inductively loaded antenna system comprising:

a ground plane, there being an area above said ground plane and an area below said ground plane;

a base insulator for supporting said monopole antenna element affixed to said ground plane, said antenna element being coupled to said base insulator in said area above said ground plane;

a loading inductance connected in said antenna element; and means connected to said antenna element and positioned in said area below said ground plane for varying the resonant frequency of said inductively loaded monopole, antenna, said varying means comprising a variable tuning capacitor;

said antenna system further comprising;

a plurality of RF impedance matching transformers; and switch means for selectively connected one of said plurality of RF impedance matching transformers to said variable tuning capacitor.

5. The antenna system of claim 4 wherein each of said plurality of RF impedance matching transformers has a different impedance.

6. The antenna system of claim 5 further comprising:

a directional coupler connected to said switch means.

7. The antenna system of claim 6 further comprising:

a meter switch connected to said directional coupler; and a power meter connected to said meter switch.

8. The antenna system of claim 7 wherein said variable tuning capacitor is connected in series with said antenna element.

9. The antenna system of claim 8 wherein said loading inductance is connected in series with said antenna element.

* * * * *